US006360160B1

(12) United States Patent
Kanamaru et al.

(10) Patent No.: US 6,360,160 B1
(45) Date of Patent: Mar. 19, 2002

(54) INTERNAL COMBUSTION ENGINE CONTROL APPARATUS AND METHOD

(75) Inventors: Masanobu Kanamaru, Mishima; Satoru Watanabe, Susono, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/544,597

(22) Filed: Apr. 6, 2000

(30) Foreign Application Priority Data

Apr. 6, 1999 (JP) ..... 11-098863

(51) Int. Cl.[7] ..... F02D 41/08; F02D 9/02
(52) U.S. Cl. ..... 701/104; 123/491
(58) Field of Search ..... 701/104; 123/491, 123/179.15, 339.1, 339.14, 339.2, 406.54, 680, 685

(56) References Cited

U.S. PATENT DOCUMENTS

| | | | | |
|---|---|---|---|---|
| 4,344,397 A | | 8/1982 | Geiger et al. | 123/339.11 |
| 4,378,770 A | * | 4/1983 | Ikeura | 123/406.53 |
| 4,513,711 A | | 4/1985 | Braun et al. | 123/339.12 |
| 4,653,452 A | * | 3/1987 | Sawanda et al. | 123/491 |
| 5,081,973 A | | 1/1992 | Minamitani | 123/339.11 |
| 5,586,534 A | | 12/1996 | Fujimoto | 123/325 |
| 5,615,660 A | * | 4/1997 | Iwano et al. | 123/680 |
| 6,152,105 A | | 11/2000 | Nishimura et al. | 123/339.11 |
| 6,212,879 B1 | | 4/2001 | Nishimura et al. | 123/406.54 |

FOREIGN PATENT DOCUMENTS

| | | | |
|---|---|---|---|
| EP | 1048838 | | 11/2000 |
| JP | 62-3139 | | 1/1987 |
| JP | 62-32250 | | 8/1987 |
| JP | 6-101609 | | 4/1994 |
| JP | 7-71293 | | 3/1995 |
| JP | 9-303189 | | 11/1997 |
| JP | 10-9030 | | 1/1998 |
| JP | 10-30480 | | 2/1998 |
| JP | 10-148154 | | 6/1998 |
| JP | 2001-59438 | * | 3/2001 |

* cited by examiner

*Primary Examiner*—John Kwon
*Assistant Examiner*—Hieu T. Vo
(74) *Attorney, Agent, or Firm*—Oblon, Spivak, McClelland, Maier & Neustadt, P.C.

(57) ABSTRACT

In a control apparatus, a peak engine revolution actual value gnepk during a present post-startup of an engine is calculated. A post-startup peak engine revolution target value tnepk is read from a map. An intake air flow QST used for the next startup is determined by multiplying the intake air flow QST used for the present startup by the ratio between the post-startup peak engine revolution actual value gnepk and the post-startup peak engine revolution target value tnepk, that is, tnepk/gnepk. This control apparatus is therefore able to control the engine revolution during the post-startup with good precision.

10 Claims, 9 Drawing Sheets

INTERNAL COMBUSTION ENGINE CONTROL APPARATUS AND METHOD

INCORPORATION BY REFERENCE

The disclosure of Japanese Patent Application Nos. HEI 11-98863 filed on Apr. 6, 1999 including the specification, drawings and abstract is incorporated herein by reference in its entirety.

BACKGROUND OF THE INVENTION

1. Field of the Invention

The present invention relates to an internal combustion engine control apparatus and, more particularly, to a control apparatus for controlling the revolution of an internal combustion engine during a post-startup of the internal combustion engine (hereinafter, "post-startup" means a period that immediately follows the startup of the engine and, more specifically, extends from the initial ignition of engine fuel until the internal combustion engine enters an idle steady state).

2. Description of the Related Art

For reducing atmospheric pollution, various automotive technologies have been, and are being, developed to reduce emissions. In this respect, improvements in emission control during a period after startup of an internal combustion engine are becoming increasingly important, and it is now demanded that during a post-startup of an internal combustion engine, the internal combustion engine be controlled with good precision and without variations. In particular, it is strongly demanded that the engine revolution during the post-startup be controlled with good precision in an intended manner, because the engine revolution during post-startup has a great and direct effect on the emissions quality.

A related internal combustion engine technology that controls the throttle opening extent so that the engine revolution reaches a target value corresponding to the engine temperature is disclosed in, for example, Japanese Patent Application Laid-Open No. SHO 62-3139.

However, the combustion in an internal combustion engine is affected not only by the engine temperature but also by various ambient conditions (e.g., ambient pressure, temperature, humidity, etc.), differences among individual engines due to variations caused during manufacture, aging of the engine, the properties of a fuel used, and the like. The effects of such factors are particularly great during the startup and during the post-startup. For example, the properties of a fuel vary depending on crude oil sources, refinery companies (and facilities of a single company), seasons of refinery (a heavy fuel containing reduced volatile components for a summer season, and a light fuel containing increased volatile components for a winter season), and the like.

FIG. 9 is a graph indicating different patterns of changes in the engine revolution during the post-startup caused by different fuel properties, where a solid line indicates a light fuel containing increased volatile components, and a broken line indicates a heavy fuel containing reduced volatile components. As indicated in FIG. 9, the engine revolution during the post-startup is considerably affected merely by the fuel properties. Various other effects are also caused by other factors as mentioned above. Therefore, it requires great amounts of manpower to find optimal set values (points of compromise) in the control of an internal combustion engine based on considerations of various effects as mentioned above. Furthermore, even if optimal values are set after a great amount of study, exposure of the internal combustion engine to a condition outside the design condition range will likely result in deterioration of combustion and degradation of emission quality.

SUMMARY OF THE INVENTION

Accordingly, it is an object of the invention to provide a control apparatus and a control method capable of controlling the revolution of an internal combustion engine during post-startup with good precision so that the post-startup revolution follows a target change pattern, without being affected by differences among individual internal combustion engines, environmental conditions, properties of a fuel used, etc.

To achieve the aforementioned and other objects, a control apparatus of an internal combustion engine in accordance with one aspect of the invention includes a post-startup revolution change index learner that stores and updates an index of a characteristic of a revolution of the internal combustion engine during a post-startup period, and a controller constructed so as to control a control quantity for controlling the revolution of the internal combustion engine during the post-startup period so that the revolution during a next post-startup period substantially follows a target characteristic, based on the index learned by the post-startup revolution change index learner. In the thus-constructed control apparatus, a post-startup revolution change index is learned, and the post-startup revolution of the internal combustion engine is controlled so that the revolution during the next post-startup period substantially follows a target characteristic, based on the learned index. As a result, the post-startup engine resolution speed does not vary, and the emission quality becomes stable, thereby contributing to the environment.

The controller may be constructed so as to control at least one of the amount of air taken into the internal combustion engine, the ignition timing, and the amount of fuel injected in the internal combustion engine. The thus-constructed controller is able to perform a control such that the next post-startup engine revolution exhibits a target characteristic by controlling at least one of the amount of intake air, the ignition timing and the amount of fuel injected, based on the index learned by the post-startup revolution change index learning device.

In a control method of an internal combustion engine in accordance with another aspect of the invention, an index of a characteristic of a revolution of the internal combustion engine during a post-startup period is stored and updated, and a control quantity for controlling the revolution of the internal combustion engine during the post-startup period is controlled so that the revolution during the next post-startup period substantially follows a target characteristic, based on the learned index. In this internal combustion engine control method, a post-startup revolution change index is learned, and the post-startup revolution of the internal combustion engine is controlled so that the revolution during the next post-startup period substantially follows a target characteristic, based on the learned index.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described in detail hereinafter with reference to the accompanying drawings.

Figure 1:
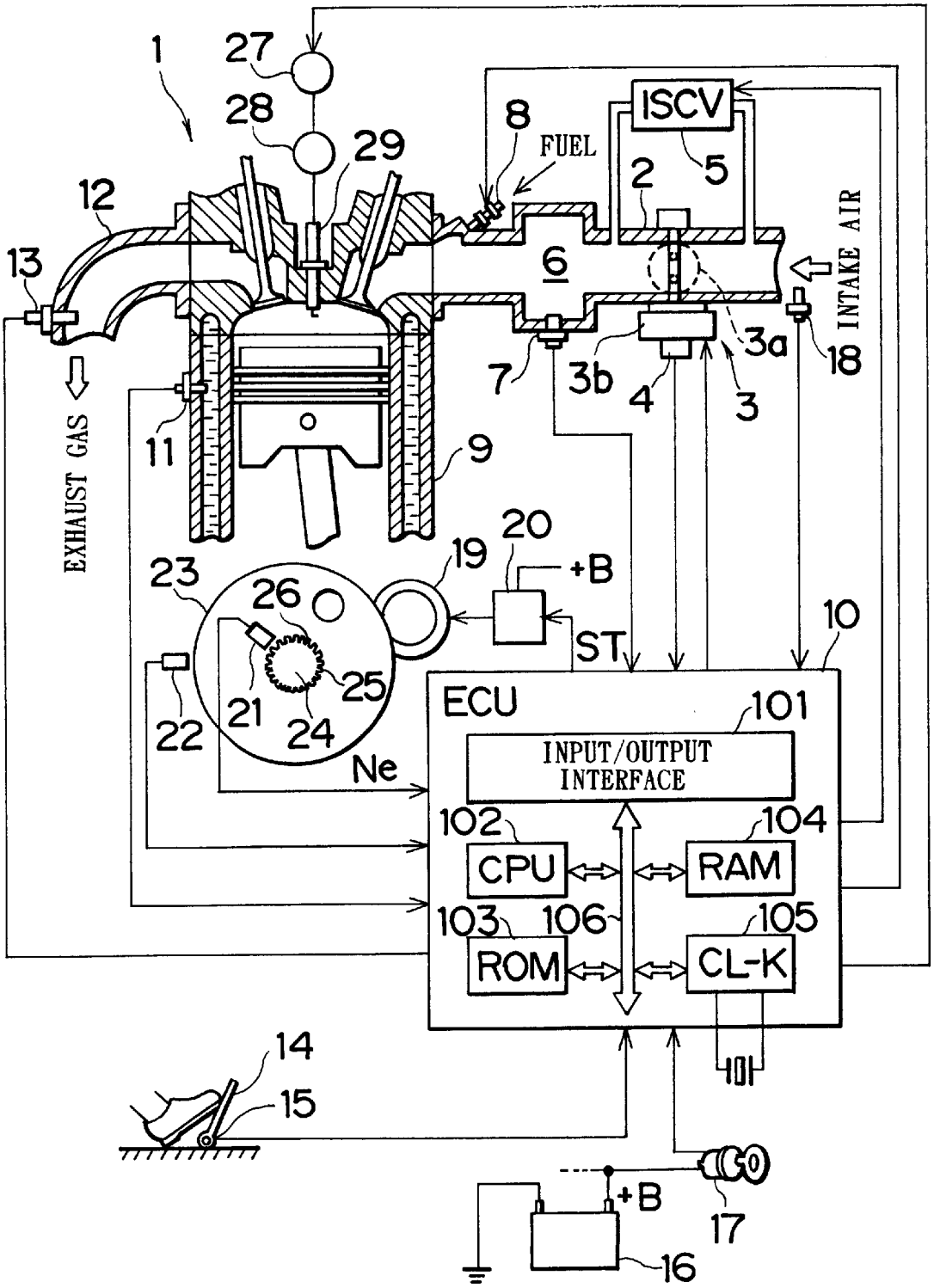
FIG. 1 is a schematic illustration of a hardware construction that is common to preferred embodiments of the invention.

FIG. 1 is a schematic illustration of a hardware construction that is common to the preferred embodiments described below. Referring to FIG. 1, an internal combustion engine 1 has an electronically controlled throttle 3 that is disposed in a portion of an intake passage 2 that extends downstream of an air cleaner (not shown). A throttle valve 3*a* of the electronically controlled throttle 3 is driven in the opening and closing directions by a throttle motor 3*b*. When an opening extent instruction value from an engine control unit (ECU) 10 is inputted to the electronically controlled throttle 3, the throttle motor 3*b* drives the throttle valve 3*a* to achieve the instructed extent of opening in response to the instruction value.

The extent of opening of the throttle valve 3*a* is controlled over a range between a completely closed state indicated by a solid line and a fully open state indicated by a broken line in FIG. 1. The opening extent of the throttle valve 3*a* is detected by a throttle opening sensor 4. The instructed extent of opening of the throttle valve 3*a* is determined in accordance with an accelerator pedal depression amount-indicating signal (accelerator operation amount signal) from an accelerator pedal depression sensor 15 that is provided on an accelerator pedal 14 for detecting the amount of depression of the accelerator pedal 14

Although the intake air flow (amount of intake air) during idling of the internal combustion engine related to the invention (described below) can sufficiently be controlled by using the electronically controlled throttle 3, the control of intake air flow during idling related to the invention may also be performed by using an idle speed control valve (hereinafter, referred to as "ISCV") 5 that is provided in a bypass passage around the throttle valve 3*a* as shown in FIG. 1.

An atmospheric pressure sensor 18 is provided in a portion of the intake passage 2 that extends upstream of the electronically controlled throttle 3. A surge tank 6 for preventing intake pulsations in the internal combustion engine is provided downstream of the electronically controlled throttle 3. A pressure sensor 7 is provided in the surge tank 6 for detecting the pressure of intake air. Disposed downstream of the surge tank 6 are fuel injection valves 8 for supplying pressurized fuel from a fuel supplying system into corresponding cylinder intake ports. The ignition of an engine fuel is performed by an igniter 27 causing electric discharge from ignition plugs 29 through the use of an ignition coil 28 based on signals from the ECU 10.

A water temperature sensor 11 for detecting the temperature of cooling water of the internal combustion engine 1 is provided in a cooling water passage 9 formed in a cylinder block of the internal combustion engine 1. The water temperature sensor 11 generates an analog voltage signal corresponding to the temperature of cooling water. An exhaust passage 12 is provided with a three-way catalytic converter (not shown) for simultaneously removing three major harmful components, that is, HC, CO and NOx, from exhaust gas. An O2 sensor 13, which is a kind of air-fuel ratio sensor, is provided in a portion of the exhaust passage 12 that extends upstream of the catalytic converter. The O2 sensor 13 generates an electric signal corresponding to the concentration of oxygen components in exhaust gas. The signals from the various sensors are inputted to the ECU 10.

The ECU 10 also accepts input of an ignition key position signal (indicating an accessory position, an on position, a starter position, and the like) from an ignition switch 17 connected to a battery 16, input of a top dead center signal TDC and a crank angle signal CA generated at every predetermined angle which are outputted from a crank angle position sensor 21 provided adjacent to a timing rotor 24 that is firmly connected to or formed together with a crankshaft timing pulley connected to an end of a crankshaft, and input of the lubricant temperature from an oil temperature sensor 22. A ring gear 23 connected to the other end of the crankshaft is rotated by a starter 19 during startup of the internal combustion engine 1.

When the internal combustion engine 1 starts to operate, the ECU 10 is energized to activate programs. The ECU 10 then receives outputs of the various sensors, and controls the throttle motor 3*b*, the ISCV 5, the fuel injection valves 8, the timing rotor 24 and other actuators. To this end, the ECU 10 has A/D converters for converting analog signals from the various sensors into digital signals, an input/output interface 101 for input of signals from the various sensors and output of drive signals to the various actuators, a CPU 102, memory devices such as a ROM 103, a RAM 104 and the like, a clock 105, and the like. These components of the ECU 10 are interconnected by a bus 106.

The detection of the engine revolution Ne, which is particularly important in the invention, will be described.

The engine revolution Ne is determined by measuring an interval (time) between predetermined crank angle signals CA. The timing rotor 24 has signal teeth 25 that are arranged substantially at every 10 degrees (with a two-teeth deleted portion 26 formed for detecting the top dead center). Therefore, the total number of signal teeth 25 of the timing rotor 24 is thirtyfour. The crank angle position sensor 21 is formed by an electromagnetic pickup, and outputs a crank rotation signal at every turn of 10 degrees.

Controls according to embodiments of the invention having the above-described hardware construction will be described below.

To stabilize the revolution of the engine, an index that indicates a change in the revolution is selected, and a control is performed so as to suppress variation of the value of the index. The controlled index may be, for example, any one of the following three indices:

(1) peak engine revolution during post-startup;

(2) mean value of the increasing rate of the engine revolution during post-startup; and (3) time needed for the engine revolution to reach a predetermined revolution during post-startup.

As a control parameter for suppressing variation of the controlled index as mentioned above, the following three parameters may be considered.

(a) intake air flow (amount of intake air);

(b) ignition timing; and (c) amount of fuel injected.

The embodiments described below are:

a first embodiment that uses controlled index (1)+control parameter (a);

a first modification of the first embodiment that uses controlled index (1)+control parameter (b);

a second modification of the first embodiment that uses controlled index (1)+control parameter (c);

a second embodiment that uses controlled index (2)+control parameter (a);

a third embodiment that uses controlled index (3)+control parameter (a); and a fourth embodiment that uses controlled index (1)+control parameters (a), (b) and (c).

FIRST EMBODIMENT

The ECU 10 learns (stores, updates) a post-startup peak engine revolution, and compares the learned value with a target value (stored in the ECU 10) that is predetermined in accordance with the engine temperature. The ECU 10 determines the value of intake air flow (instruction value) for the next startup by correcting the value for the present startup so that the next post-startup peak engine revolution becomes equal to the target value.

Figure 2A:
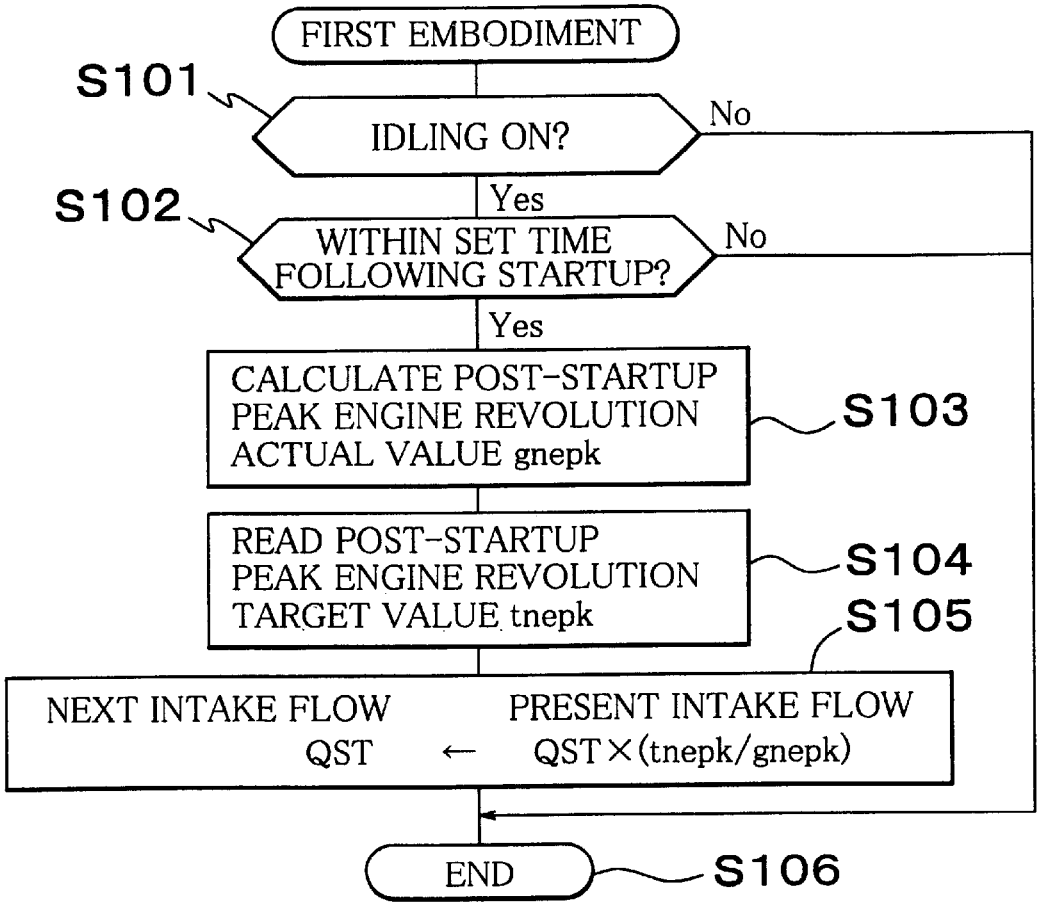
FIG. 2A is a flowchart illustrating a control operation according to a first embodiment of the invention.

FIG. 2A is a flowchart illustrating a control operation performed in the first embodiment. In step 101, the ECU 10 determines whether the internal combustion engine 1 is in the idling state, based on a signal from the throttle opening sensor 4 or the accelerator pedal depression sensor 15. In step 102, the ECU 10 determines whether time still remains within a predetermined set time following the startup of the engine, based on a time measured by a timer that starts simultaneously with the startup of the engine. If the affirmative determination is made in both steps 101 and 102, the process proceeds to step 103. In step 103, the ECU 10 calculates a present post-startup peak engine revolution actual value gnepk. Subsequently in step 104, the ECU 10 reads a post-startup peak engine revolution target value tnepk from a map. Subsequently in step 105, the ECU 10 calculates an intake air flow QST used for the next startup of the engine by multiplying the intake air flow QST used for the present startup by a ratio between the post-startup peak engine revolution actual value gnepk and the post-startup peak engine revolution target value tnepk, that is, tnepk/gnepk. In step 106, the process ends.

Figure 2B:
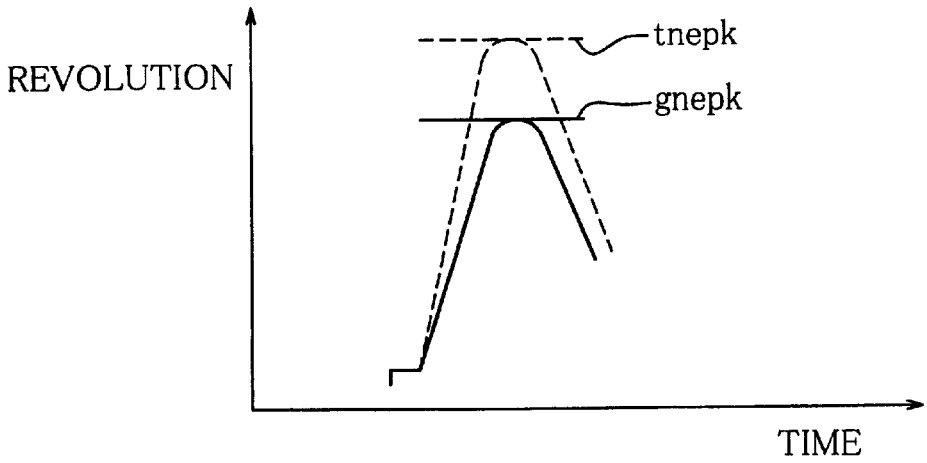
FIG. 2B is a graph illustrating the control according to the first embodiment.

If the negative determination is made in step 101 or 102, the process ends immediately. FIG. 2B is a graph illustrating the concept of the control according to the first embodiment.

In the graph of FIG. 2B, the actual engine revolution during post-startup is indicated by a solid line, and the engine revolution target values during post-startup are indicated by a broken line. The engine revolution temporarily rises after startup, and then reaches an idle revolution. The post-startup peak engine revolution actual value gnepk is lower than the peak engine revolution target value tnepk at that time point. Therefore, during the next post-startup, the air flow to the engine is controlled so that the engine revolution becomes equal to the peak engine revolution target value at the peak engine speed time. More specifically, during the next startup of the engine, the electronically controlled throttle 3 or the ISCV 5 is controlled so that the intake air flow QST determined in step 105 is provided, and the engine revolution during the post-startup becomes equal to the target value.

In the first embodiment, the intake air flow is corrected so that the peak engine revolution during post-startup becomes equal to the target value, as described above. As a result, the post-startup engine revolution characteristic does not vary, so that the emissions quality becomes stable.

First Modification of First Embodiment

The ECU 10 learns (stores, updates) a post-startup peak engine revolution, and compares the learned value with a target value (stored in the ECU 10) that is predetermined in accordance with the engine temperature. The ECU 10 determines the value of ignition timing (instruction value) for the next startup by correcting the value for the present startup so that the next post-startup peak engine revolution becomes equal to the target value.

Figure 3:
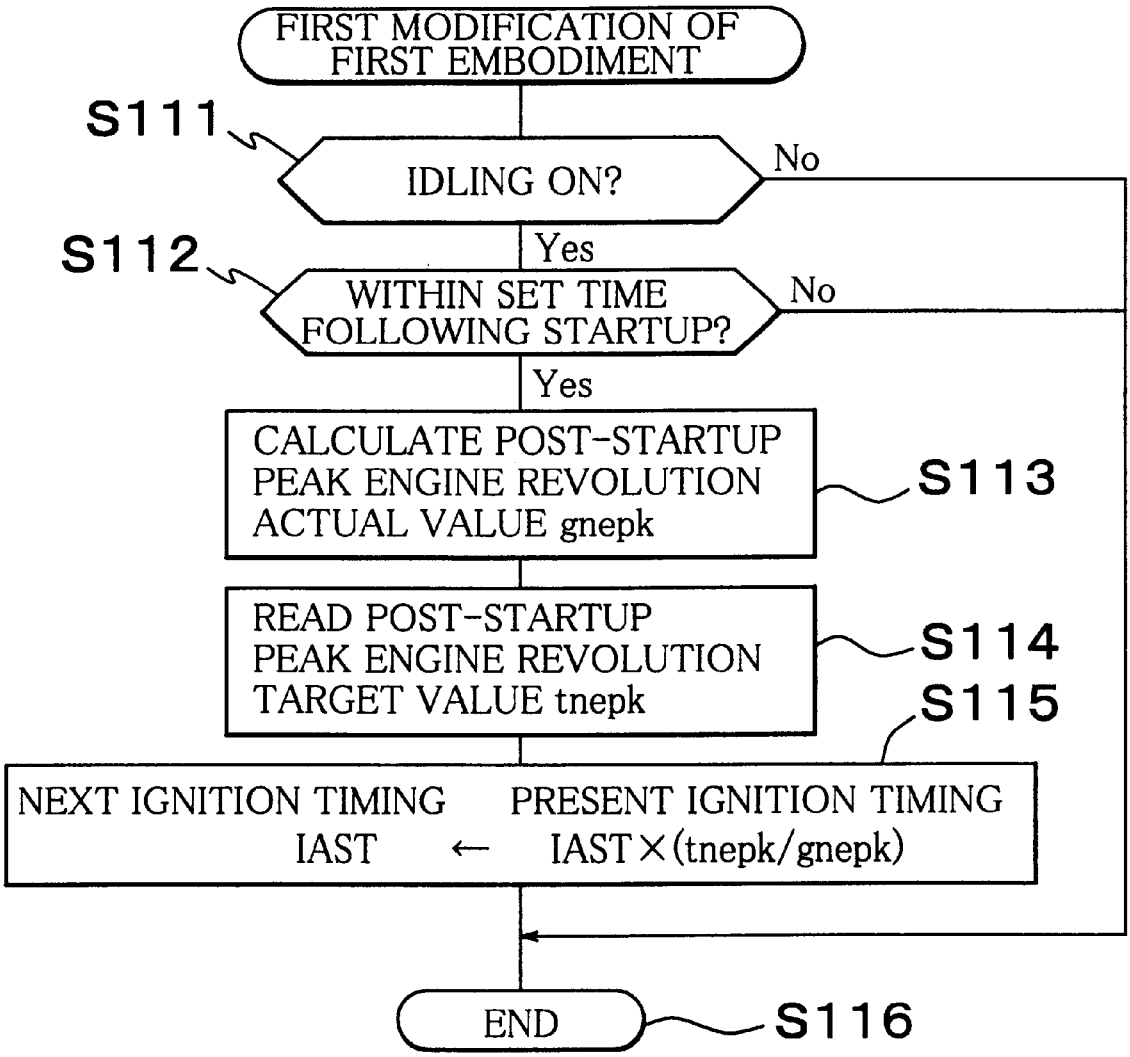
FIG. 3 is a flowchart illustrating a control operation according to a first modification of the first embodiment.

FIG. 3 is a flowchart illustrating a control operation according to the first modification of the first embodiment. Steps 111, 112, 113, 114 are the same as steps 101, 102, 103, 104 in the first embodiment shown in FIG. 2. In step 115 in FIG. 3, the ECU 10 calculates an ignition timing IAST used for the next startup of the engine by multiplying the ignition timing IAST used for the present startup by a ratio between the post-startup peak engine revolution actual value gnepk and the post-startup peak engine revolution target value tnepk, that is, tnepk/gnepk. In step 116, the process ends.

During the next startup of the engine, the ECU 10 outputs an instruction to the igniter 27 so that the ignition timing IAST determined in step 115 is achieved.

In the first modification of the first embodiment, the ignition timing is corrected so that the peak engine revolution during post-startup becomes equal to the target value, as described above. As a result, the post-startup engine revolution characteristic does not vary, so that the emissions quality becomes stable.

Second Modification of First Embodiment

The ECU 10 learns (stores, updates) a post-startup peak engine revolution gnepk, and compares the learned value with a target value (stored in the ECU 10) that is predetermined in accordance with the engine temperature. The ECU 10 determines the value of amount of fuel injected (instruction value) for the next startup by correcting the value for the present startup so that the next post-startup peak engine revolution becomes equal to the target value.

Figure 4:
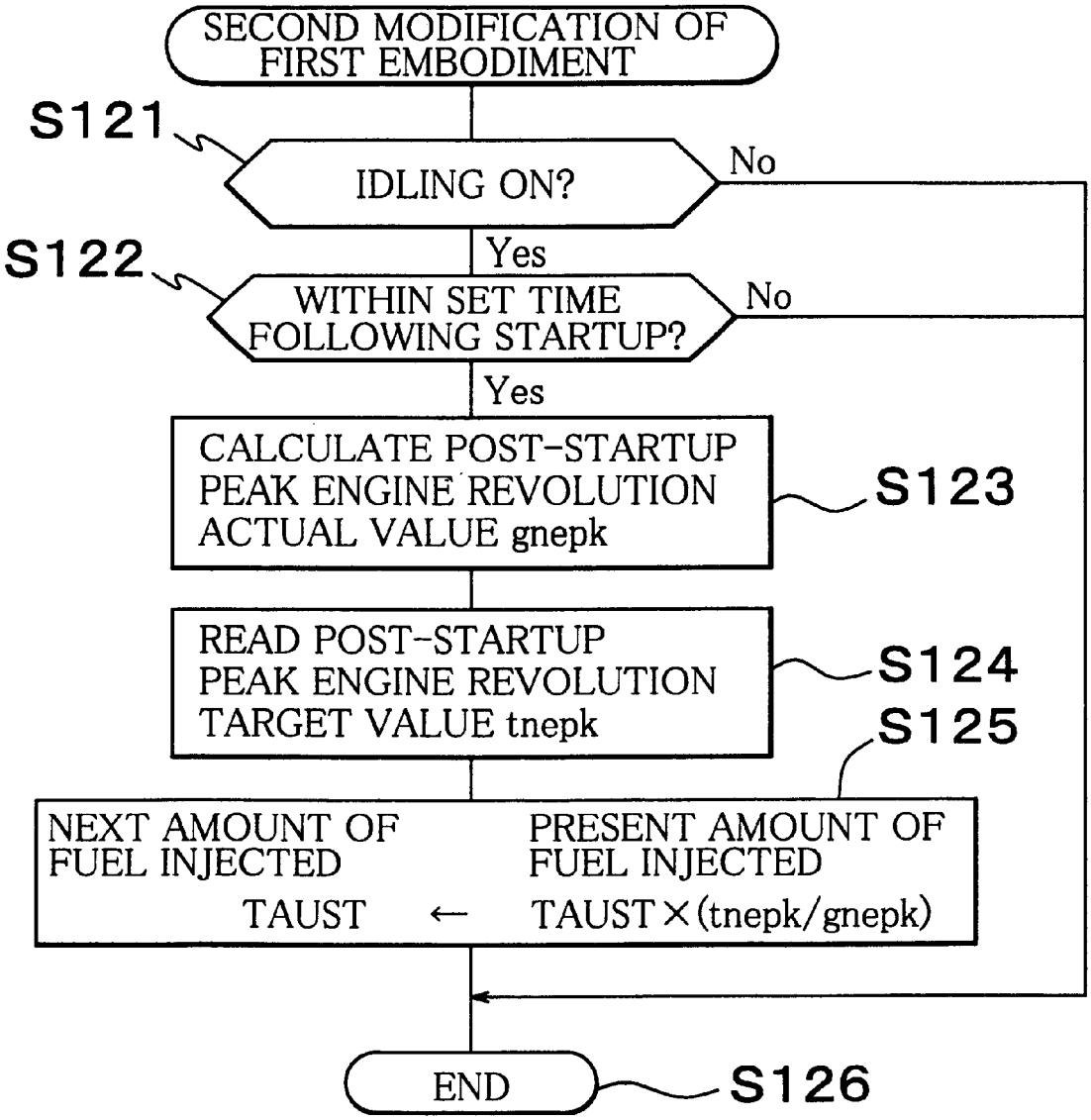
FIG. 4 is a flowchart illustrating a control operation according to a second modification of the first embodiment.

FIG. 4 is a flowchart illustrating a control operation according to the second modification of the first embodiment. Steps 121, 122, 123, 124 are the same as steps 101, 102, 103, 104 in the first embodiment shown in FIG. 2. In step 125 in FIG. 4, the ECU 10 calculates an amount of fuel injected TAUST used for the next startup of the engine by multiplying the amount of fuel injected TAUST used for the present startup by the ratio between the post-startup peak engine revolution actual value gnepk and the post-startup peak engine revolution target value tnepk, that is, tnepk/gnepk.

During the next startup of the engine, the ECU 10 outputs an instruction to the fuel injection valves 8 so that the amount of fuel injected TAUST determined in step 125 is achieved.

In the second modification of the first embodiment, the amount of fuel injected is corrected so that the peak engine revolution during the post-startup becomes equal to the target value, as described above. As a result, the post-startup engine revolution characteristic does not vary, so that the emissions quality becomes stable.

SECOND EMBODIMENT

The ECU 10 learns (stores, updates) a post-startup engine revolution increasing rate mean value, and compares the learned value with a target value (stored in the ECU 10) that is predetermined in accordance with the engine temperature. The ECU 10 determines the value of intake air flow (instruction value) for the next startup by correcting the value for the present startup so that the next post-startup peak engine revolution becomes equal to the target value.

Figure 5A:
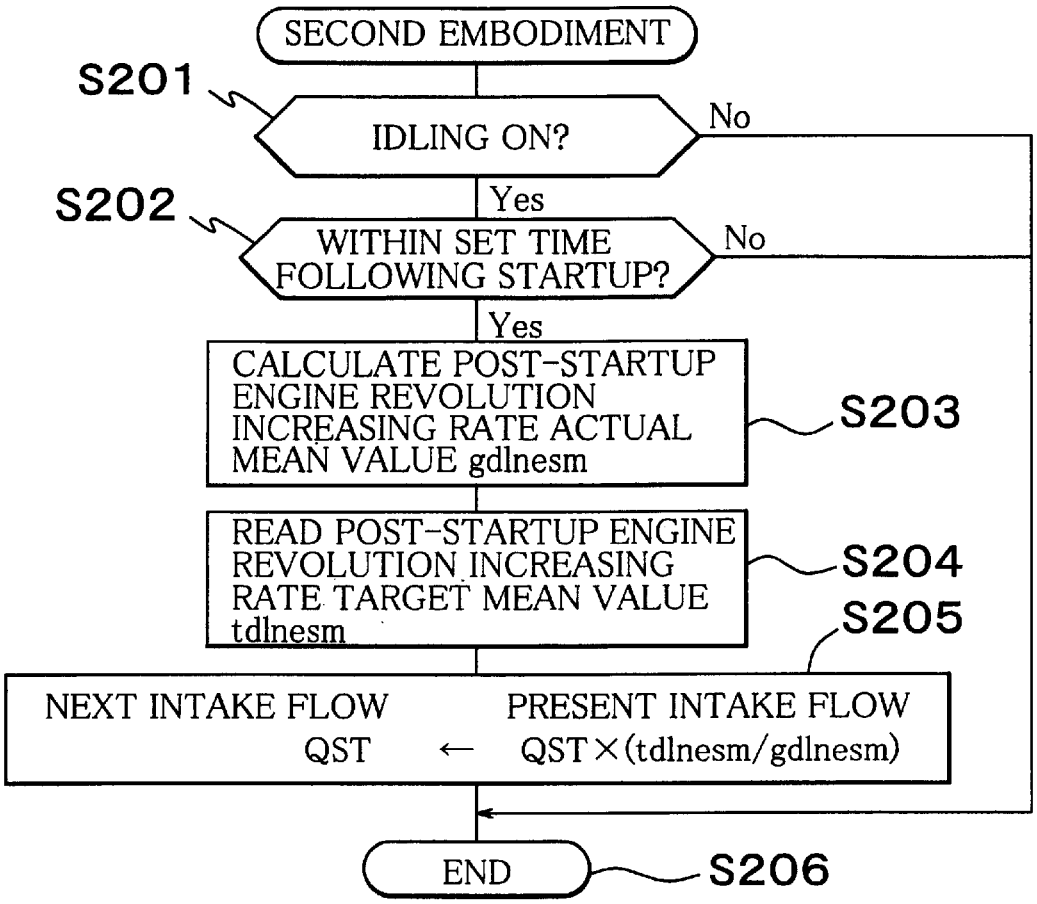
FIG. 5A is a flowchart illustrating a control operation according to a second embodiment of the invention.

FIG. 5A is a flowchart illustrating a control operation according to the second embodiment. Steps 201, 202 are the same as steps 101, 102 in the first embodiment in FIG. 2A. In step 203, the ECU 10 calculates the present post-startup engine revolution increasing rate actual mean value gdlnesm. Subsequently in step 204, the ECU 10 reads a post-startup engine revolution increasing rate target mean value tdlnesm from a map. Subsequently in step 205, the ECU 10 calculates an intake air flow QST used for the next startup of the engine by multiplying the intake air flow QST used for the present startup by a ratio between the post-startup engine revolution increasing rate actual mean value gdlnesm and the post-startup engine revolution increasing rate target mean value tdlnesm, that is, tdlnesm/gdlnesm. In step 206, the process ends.

In the second embodiment, the intake air flow is corrected so that the post-startup engine revolution increasing rate mean value becomes equal to the target value, as described above. As a result, the post-startup engine revolution characteristic does not vary, so that the emissions quality becomes stable.

Figure 5B:
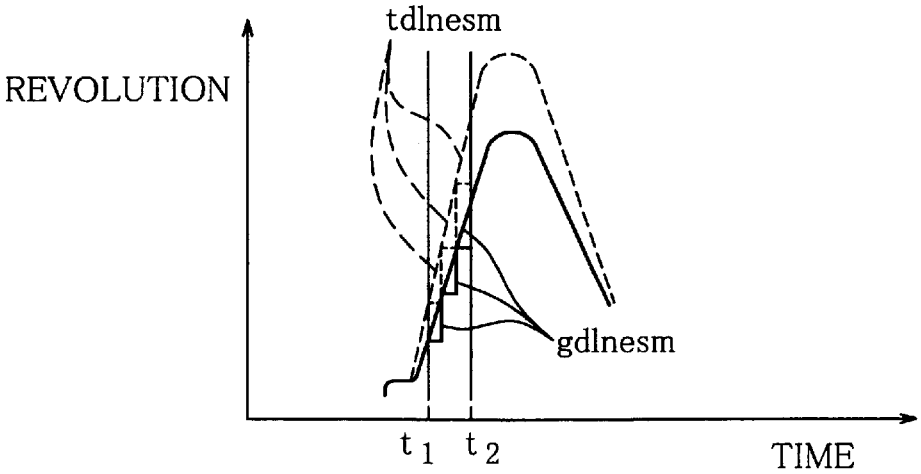
FIG. 5B is a graph illustrating the control according to the second embodiment.

FIG. 5B is a graph illustrating the concept of the control according to the second embodiment. In the graph of FIG. 5B, the actual engine revolution during post-startup is indicated by a solid line, and the engine revolution target values during post-startup are indicated by a broken line. The engine revolution temporarily rises after the startup, and then reaches an idle revolution, as also indicated in FIG. 2B. The engine revolution increasing rate mean value gdlnesm is determined as a mean value of increasing rates that are determined at every predetermined short time within a predetermined period t1-t2 after startup. As indicated in FIG. 5B, the engine revolution increasing rate actual mean value gdlnesm is lower than the target mean value tdlnesm. Therefore, during the next post-startup, the engine revolution is controlled so that the engine revolution increasing rate becomes equal to the target value tdlnesm.

More specifically, during the next startup of the engine, the electronically controlled throttle 3 or the ISCV 5 is controlled so that the intake air flow QST determined in step 205 is provided, and the engine revolution during the post-startup becomes equal to the target value. It is also possible to provide modifications of the second embodiment similar to those of the first embodiment. For example, the internal combustion engine control apparatus of the second embodiment may also be constructed so as to control the ignition timing or the amount of fuel injected so that the post-startup engine revolution increasing rate mean value becomes equal to the target mean value. Detailed description of such modifications of the second embodiment is omitted.

THIRD EMBODIMENT

The ECU 10 learns (stores, updates) a post-startup predetermined engine revolution reach time (i.e., the time needed for the engine revolution to reach a predetermined revolution during post-startup) gtrps, and compares the learned value with a target value of the post-startup predetermined engine revolution reach time (stored in the ECU 10) that is predetermined in accordance with the engine temperature. The ECU 10 determines the value of intake air flow (instruction value) for the next startup by correcting the value for the present startup so that the next post-startup peak engine revolution becomes equal to the target value.

Figure 6A:
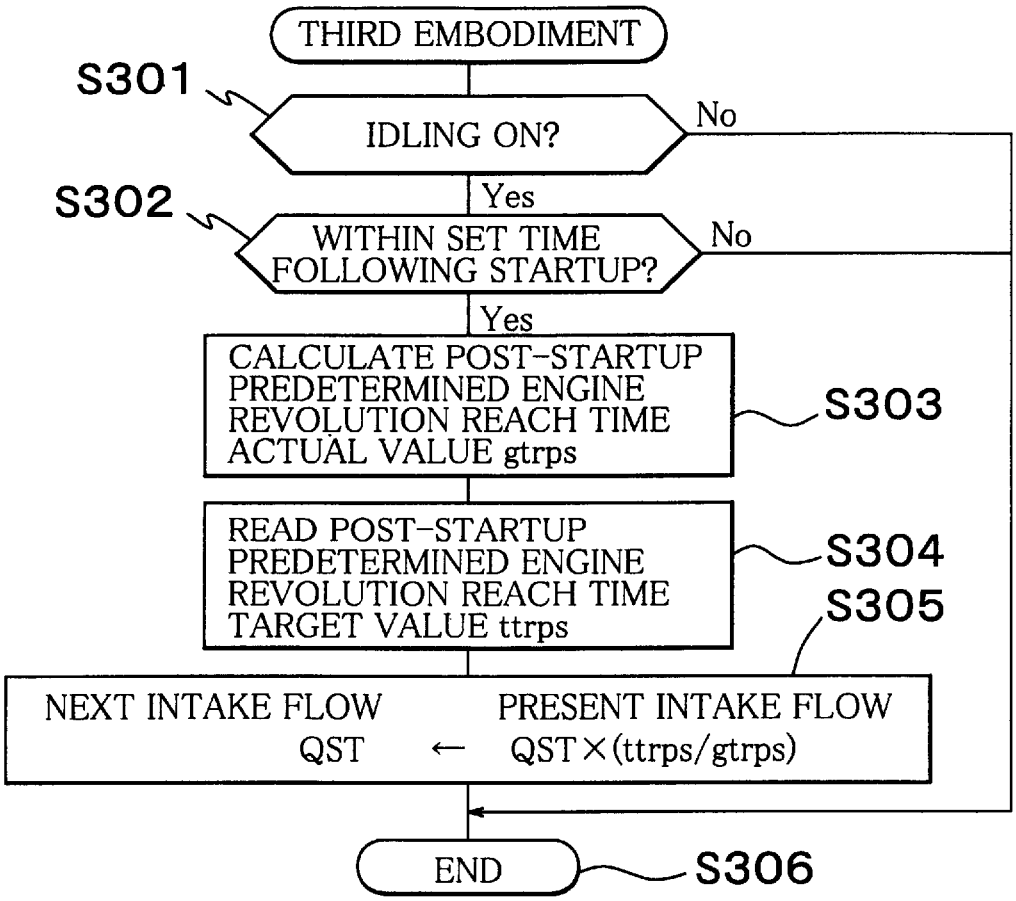
FIG. 6A is a flowchart illustrating a control operation according to a third embodiment of the invention.

FIG. 6A is a flowchart illustrating a control operation according to the third embodiment. Steps 301, 302 are the same as steps 101, 102 in the first embodiment in FIG. 2A. In step 303, the ECU 10 calculates a present post-startup predetermined engine revolution reach time actual value gtrps. Subsequently in step 304, the ECU 10 reads a post-startup predetermined engine revolution reach time target value ttrps from a map. Subsequently in step 305, the ECU 10 calculates an intake air flow QST used for the next startup of the engine by multiplying the intake air flow QST used for the present startup by a ratio between the post-startup predetermined engine revolution reach time actual value gtrps and the post-startup predetermined engine revolution reach target time value ttrps, that is, ttrps/gtrps. In step 306, the process ends.

In the third embodiment, the intake air flow is corrected so that the post-startup predetermined engine revolution reach time becomes equal to the target value, as described above. As a result, the post-startup engine revolution characteristic does not vary, so that the emissions quality becomes stable.

Figure 6B:
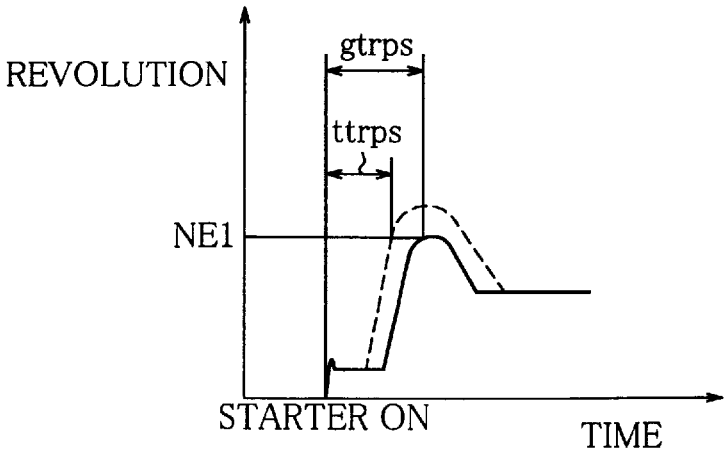
FIG. 6B is a graph illustrating the control according to the third embodiment.

FIG. 6B is a graph illustrating the concept of the control according to the third embodiment.

In the graph of FIG. 6B, the actual engine revolution during post-startup is indicated by a solid line, and the engine revolution target values during post-startup are indicated by a broken line. The engine revolution temporarily rises after startup, and then reaches an idle revolution, as also indicated in FIG. 2B. The time needed for the engine revolution to reach athe predetermined engine revolution NE is measured by the clock 105. As indicated in FIG. 6B, the post-startup predetermined engine revolution reach time gtrps is lower than the target time value ttrps. Therefore, during the next post-startup, the engine revolution is controlled so that the post-startup predetermined engine revolution reach time is reduced to the target time value ttrps.

More specifically, during the next startup of the engine, the electronically controlled throttle 3 or the ISCV 5 is controlled so that the intake air flow QST determined in step 205 is provided, and the engine revolution during post-startup becomes equal to the predetermined engine revolution at the target time value. It is also possible to provide modifications of the third embodiment similar to those of the first embodiment. For example, the internal combustion engine control apparatus of the third embodiment may also be constructed so as to control the ignition timing or the amount of fuel injected so that the post-startup engine revolution reaches the predetermined engine revolution at the target time value. Detailed description of such modifications of the third embodiment is omitted.

FOURTH EMBODIMENT

The ECU 10 is corrects the intake air flow, the ignition timing, and the amount of fuel injected so that the post-startup peak engine revolution becomes equal to the target value, and changes these parameters in accordance with conditions. The sensitivity coefficients of the intake air flow, the ignition timing, and the amount of fuel injected in accordance with the ratio between the post-startup peak engine revolution actual value gnepk and the post-startup peak engine revolution target value tnepk, that is, tnepk/gnepk, are determined and stored in maps beforehand. Suitable values are read from the maps of the sensitivity coefficients for use in the control.

Figure 7A:
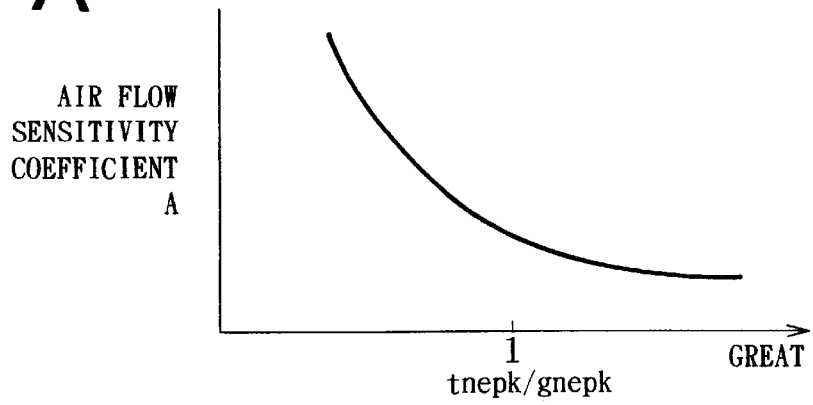
FIGS. 7A, 7B and 7C are graphs indicating a sensitivity coefficient of the amount of intake air, a sensitivity coefficient of the ignition timing, and a sensitivity coefficient of the amount of fuel injected, respectively, which are control parameters used in a control according to a fourth embodiment of the invention.
Figure 7B:
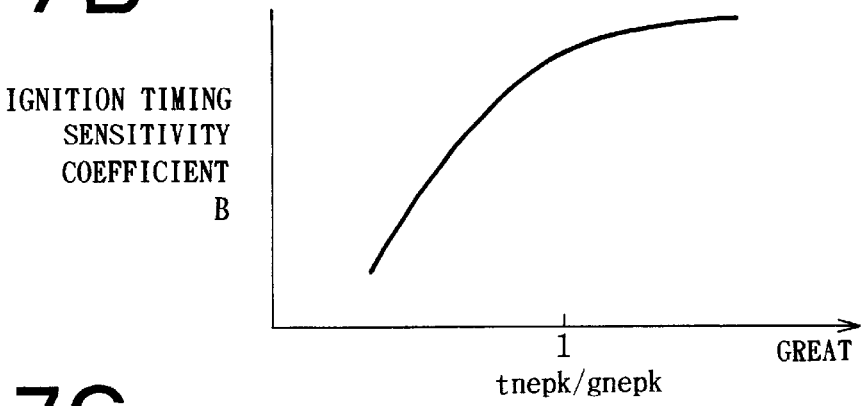
Figure 7C:
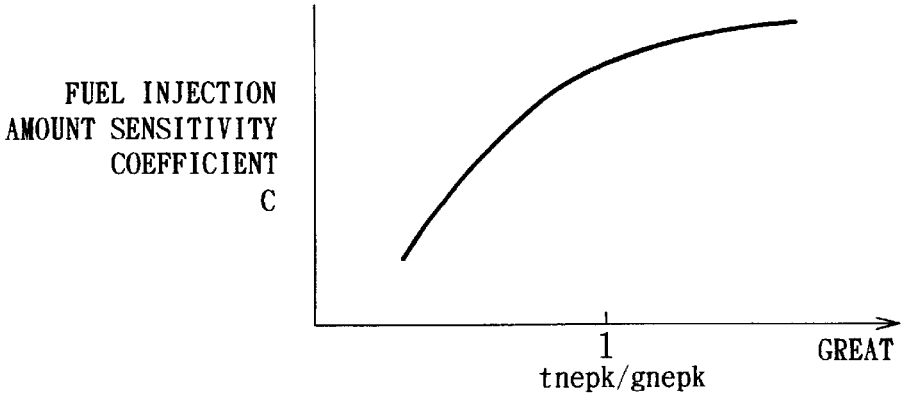

FIGS. 7A, 7B and 7C show maps indicating the sensitivity coefficients A, B and C of the intake air flow, the ignition timing, and the amount of fuel injected, respectively, against the ratio tnepk/gnepk on the horizontal axis. The sensitivity coefficients A, B and C are pre-stored in the ECU 10.

The numerator and denominator of tnepk/gnepk are a target value and an actual value, respectively. A value of tnepk/gnepk greater than 1 (toward the right side along the horizontal axis) means that the actual engine revolution is lower than the target value. A value of tnepk/gnepk less than 1 (toward the left side along the horizontal axis) means that the actual engine revolution is higher than the target value. As indicated in FIG. 7A, the sensitivity coefficient A of the intake air flow is set so as to increase as the ratio tnepk/gnepk decreases, that is, as the actual engine revolution becomes greater than the target value. As indicated in FIGS. 7B and 7C, the sensitivity coefficient B of the ignition timing and the sensitivity coefficient C of the amount of fuel injected are set so as to increase as the ratio tnepk/gnepk increases, that is, as the actual engine revolution becomes smaller than the target value. The reasons for this will be described below.

It is often the case that a decrease in the engine revolution during post-startup of the engine is caused by a lean shift of the air-fuel ratio. For example, if a heavy fuel is used, fuel spraying sometimes becomes poor so that fuel deposits on intake port wall surfaces or the like and, therefore, the entire amount of fuel injected is not introduced into the combustion chamber. In such a case, the air-fuel ratio shifts to the fuel-lean side, so that the engine revolution decreases. If the intake air flow is increased to increase the engine torque in that case, the vacuum level in the intake pipe decreases, so that the fuel spraying quality further deteriorates. That it, this situation cannot be coped simply by the control based on the intake air flow. In this situation, therefore, the control based on the intake air flow is limited, and a control based on the ignition timing and the amount of fuel injected is expanded (that is, the rates of contribution of the ignition timing and the amount of fuel injected to the control are increased).

Figure 8:
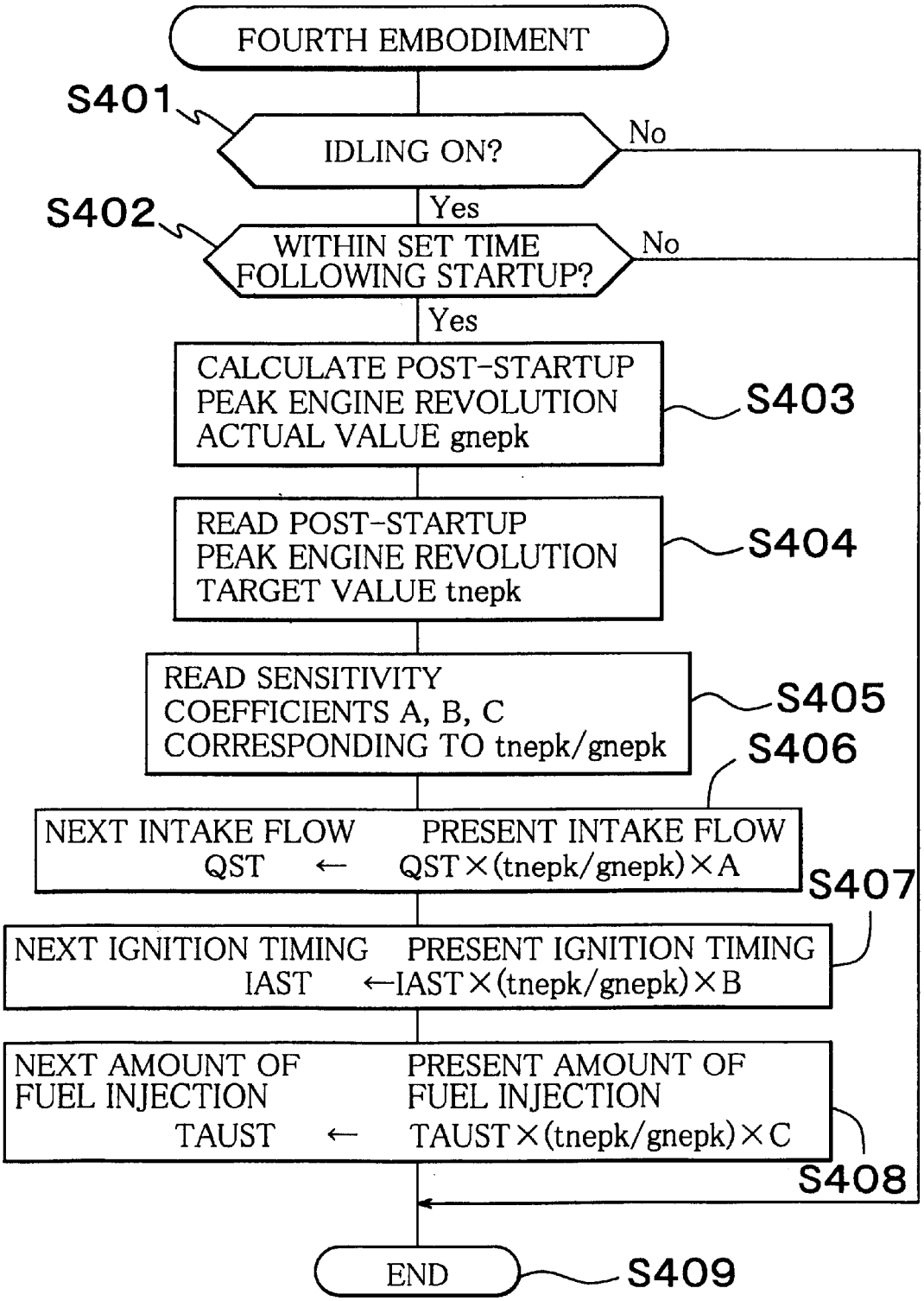
FIG. 8 is a flowchart illustrating a control operation according to the fourth embodiment.
Figure 9:
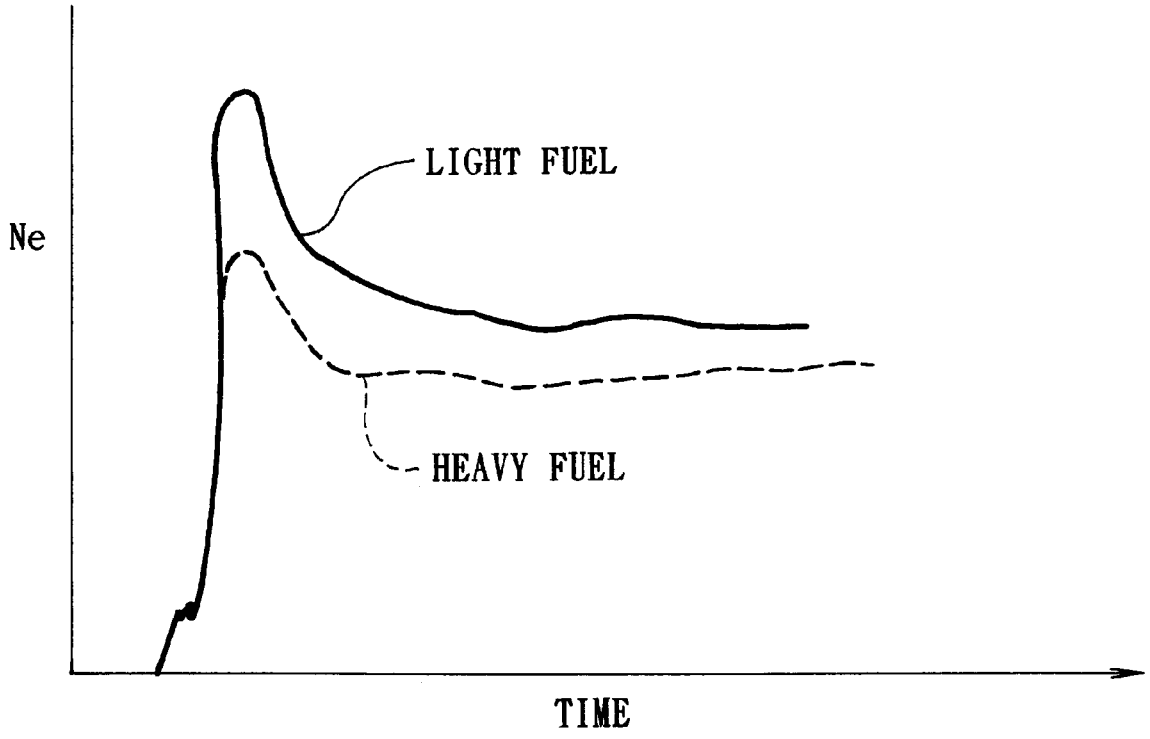
FIG. 9 is a graph indicating different changing patterns of the revolution during post-startup due to different fuel properties according to a related art.

FIG. 8 is a flowchart illustrating a control operation according to the fourth embodiment.

Steps 401–404 in FIG. 8 are the same as steps 101–104 in the first embodiment. In step 405, the sensitivity coefficients A, B and C for the intake air flow, the ignition timing and the amount of fuel injected in accordance with the ratio tnepk/gnepk are read from the maps indicated in FIGS. 7A, 7B and 7C, respectively.

In step 406, the next post-startup intake air flow QST is determined by multiplying the present post-startup intake air flow QST by the ratio tnepk/gnepk and the sensitivity coefficient A. In step 407, the next post-startup ignition timing IAST is determined by multiplying the present post-startup ignition timing IAST by the ratio tnepk/gnepk and the sensitivity coefficient B. In step 408, the next post-startup amount of fuel injected TAUST is determined by multiplying the present post-startup amount of fuel injected TAUST by the ratio tnepk/gnepk and the sensitivity coefficient C.

In the fourth embodiment, the intake air flow, the ignition timing and the amount of fuel injected are corrected in a suitable combination in accordance with the situation so that the post-startup peak engine revolution becomes equal to the target value. As a result, the post-startup engine revolution characteristic does not vary, so that the emissions quality becomes stable.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A control apparatus in an internal combustion engine, comprising:

a post-startup revolution change index learner that stores and updates an index of a characteristic of a revolution of the internal combustion engine during a post-startup period; and a control quantity controller constructed so as to control a control quantity for controlling the revolution of the internal combustion engine during the post-startup period so that the revolution during a next post-startup period substantially follows a target characteristic, based on the index learned by the post-startup revolution change index learner, wherein the control quantity controller comprises:

an intake air amount controller that is disposed in an intake passage of the internal combustion engine and that controls an amount of intake air taken into the internal combustion engine;

an ignition timing controller that controls an ignition timing in the internal combustion engine; and a fuel injection amount controller that controls an amount of fuel injected in the internal combustion engine, and wherein the control quantity controller controls the revolution during the next poststartup period by using at least one of the intake air amount controller, the ignition timing controller and the fuel injection amount controller.

2. A control apparatus of an internal combustion engine according to claim 1, wherein the index of a characteristic of the revolution of the internal combustion engine is a peak revolution of the internal combustion engine during the post-startup period.

3. A control apparatus of an internal combustion engine according to claim 1, wherein the index of a characteristic of the revolution of the internal combustion engine is a revolution increasing rate during the post-startup period.

4. A control apparatus of an internal combustion engine according to claim 1, wherein the index of a characteristic of the revolution of the internal combustion engine is a reach time that is needed for the revolution of the internal combustion engine to reach a predetermined value during the post-startup period.

5. A control apparatus of an internal combustion engine according to claim 1, wherein the control quantity controller is constructed to give a higher priority to a control through the intake air amount controller than to controls through the ignition timing controller and the fuel injection amount controller, in a range where a control of the internal combustion engine based on the amount of intake air is effective.

6. A control apparatus of an internal combustion engine according to claim 1, wherein the control quantity controller is constructed to give a higher priority to a control through at least one of the ignition timing controller and the fuel injection amount controller than to other controls when conditions are such that the control of the internal combustion engine based on the amount of intake air will be ineffective.

7. A control method of an internal combustion engine, comprising:

a first step of storing and updating an index of a characteristic of a revolution of the internal combustion engine during a post-startup period; and a second step of controlling a control quantity for controlling the revolution of the internal combustion engine during the post-startup period so that the revolution during a next post-startup period substantially follows a target characteristic, based on the index learned in the first step, wherein as the control quantity, at least one of an amount of intake air taken into the internal combustion engine, an ignition timing in the internal combustion engine, and an amount of fuel injected in the internal combustion engine is controlled in the second step.

8. A control method of an internal combustion engine according to claim 7, wherein the index of a characteristic of the revolution of the internal combustion engine is a peak revolution of the internal combustion engine during the post-startup period.

9. A control method of an internal combustion engine according to claim 7, wherein the index of a characteristic of the revolution of the internal combustion engine is a revolution increasing rate during the post-startup period.

10. A control method of an internal combustion engine according to claim 7, wherein the index of a characteristic of the revolution of the internal combustion engine is a reach time that is needed for the revolution of the internal combustion engine to reach a predetermined value during the post-startup period.

* * * * *